United States Patent [19]

Hüsselmann

[11] 4,025,286

[45] May 24, 1977

[54] APPARATUS FOR IMPROVING THE OPERATION OF OIL-FIRED BOILERS

[76] Inventor: Wilhelm Hüsselmann, Eisenweg 54, 524 Betzdorf, Germany

[22] Filed: Aug. 14, 1975

[21] Appl. No.: 604,639

[30] Foreign Application Priority Data

Aug. 23, 1974 Germany ..... 2440451

[52] U.S. Cl. ..... 431/171; 110/97 R; 431/347

[51] Int. Cl.[2] ..... F23M 9/06

[58] Field of Search ..... 431/347, 171, 2, 115, 431/116; 110/97 R, 97 D

[56] References Cited

UNITED STATES PATENTS

| | | | |
|---|---|---|---|
| 1,305,436 | 6/1919 | Blanchard | 431/171 |
| 1,720,089 | 7/1929 | Murray et al. | 431/171 |
| 1,978,517 | 10/1934 | Wetherbee | 431/347 X |
| 1,993,251 | 3/1935 | Surry | 431/171 X |

*Primary Examiner*—Edward G. Favors

[57] ABSTRACT

Apparatus for improving the operation of oil-fired boilers comprising an oil burner and a combustion chamber the wall zone of which is provided with water-conducting cavities and longitudinal and transverse bores or recesses disposed in the combustion chamber at a specific distance in front of the wall situated opposite to the oil burner.

8 Claims, 2 Drawing Figures

APPARATUS FOR IMPROVING THE OPERATION OF OIL-FIRED BOILERS

The innovation relates to apparatus for improving the operation of oil-fired boilers which are provided with an oil burner and a combustion chamber the wall zone of which is provided with water-conducting cavities.

Oil-fired boilers of this kind are used for flats, one-family houses and multiple occupation dwellings, the heating rate being adapted to changing requirements by switching on and off of the oil burner operation. The efficiency is an important factor for such oil-fired boilers and depends on the complete combustion of the oil, on optimum thermal transfer to the water which is to be heated, on the quantity of heated air which is discharged through the chimney without participating in combustion and on other factors. The technological effort would have to be increased for oil-fired boilers in order to optimize the combustion conditions but this would render the system more complicated and more expensive. Accordingly, there is therefore a demand for a step which can provide successful results in a series of oil-fired boilers but without calling for an explanation which is scientifically convincing.

It is the object of the innovation to make available a simple device by means of which the operation of oil-fired boilers can be improved in specific cases and this can be determined by means of a test.

The problem is solved by one or more incombustible blocks which are provided with longitudinal and transverse bores or recesses and are disposed in the combustion chamber at a specific distance from the wall which is situated opposite to the oil burner. Surprisingly, this step improves the operation of some oil-fired boilers in the sense of saving oil, a feature which can be determined on the basis of the cut-in and cut-out times of the oil burner under conditions of approximately constant outside temperatures and heating operation. The mechanism of this action has not been completely explained and it is possible that the substantially heated blocks encourage complete combustion because of their temperature and because of their ability to subdivide and deflect the point of the burner flame.

Further details of the innovation are disclosed in the description of one exemplified embodiment which is explained by reference to the accompanying drawing, in which.

Figure 1:
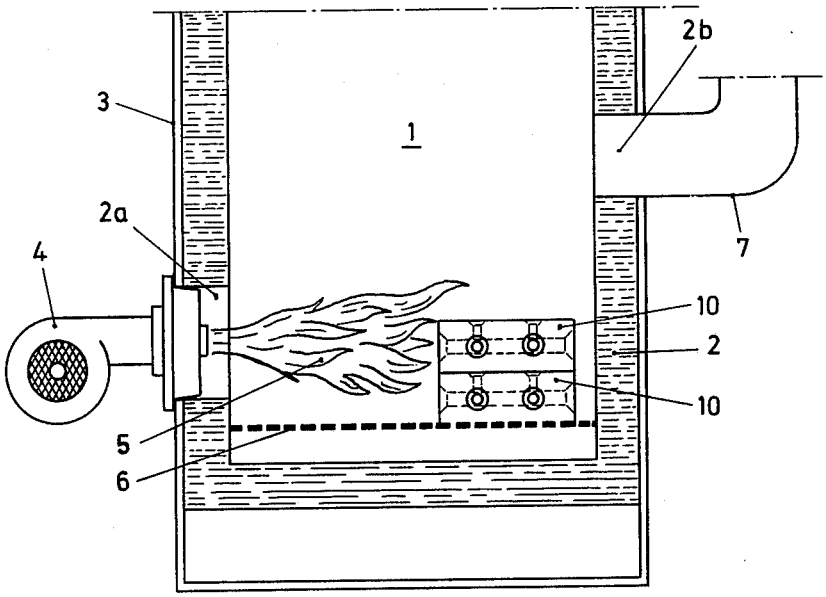
FIG. 1 is a diagrammatic longitudinal section through an oil-fired boiler.

It is known that conventional oil-fired boilers comprise a combustion chamber 1 the wall 2 of which is provided with water-conducting cavities, also with an insulating jacket 3 disposed towards the exterior. An oil burner 4 is disposed in front of an opening 2*a* of the wall 2 and intermittently draws oil from a storage tank and sprays said oil in finely divided form into the combustion chamber 1 where a flame 5 is formed. A grid 6 is usually provided in the bottom region of the oil-fired boiler. The smoke gases pass via an extraction opening 2*b* into a chimney pipe 7 and from there via the chimney into atmosphere. Efforts are made in operating the oil-fired boiler on the one hand to ensure that oil is completely burned and on the other hand that the excess of air is not too large because a large amount of heat would then be discharged through the chimney.

However, the amount of air discharged through the chimney should also be small in the intervals of oil burner operation.

It has been found that metal blocks 10 which are introduced into the combustion chamber 1 reduce the oil consumption if the said metal blocks are situated at a specific distance in front of the rear wall 2, i.e. opposite to the oil burner 4. The grid 6 which is normally provided is suitable as a support. The number of metal blocks 10 must be determined by trial and may amount to four.

Figure 2:
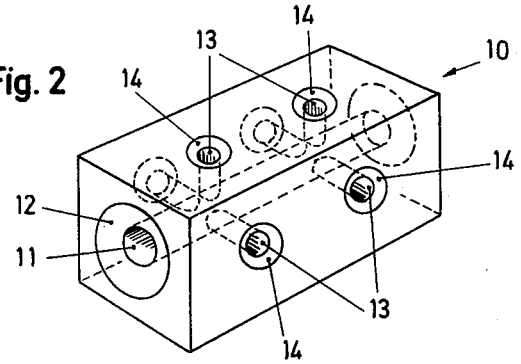
FIG. 2 shows a single block according to the innovation.

A single metal block 10 is illustrated in FIG. 2. The exterior is block-shaped in one embodiment has a length of 15 cm and width and height of 8 cm. The metal block 10 is provided with a longitudinal bore or recess 11 which is flared in the outward direction, as indicated at 12. Two rows of transverse bores 13 which extend to the median longitudinal bore 11 and are also provided with flared transition zones 14 are also provided. The downward bore is missing in the metal block 10 which is provided for the bottommost layer. In the exemplified embodiment the longitudinal bore has a diameter of approximately 3.5 cm and the transverse bores have diameters of 1.5 cm. The metal block material is preferably cast iron.

The point of the flame 5 occasionally reaches the metal blocks 10 and heats these until they reach red heat in operation of the oil-fired boiler. The heat radiation transmitted by the metal blocks 10 as the result of these high temperatures reaches the walls 2 of the boiler and is thus substantially completely absorbed by the water which is to be heated. The high temperature of the metal block 10 also assists complete combustion of gasified oil since the streams of gas are subdivided by the metal blocks 10 thus assisting the chance mixing of such partial flows with air and therefore with oxygen. The excess of air for complete combustion can thus be minimized.

The strongly heated metal blocks 10 produce convection flow in the operating intervals of the burner 4, such convection flow passing like a curtain along the extraction opening 2*b* and resulting in a certain blockage of the said extraction opening. The amount of heat discharged via the chimney during the intervals in thus kept low.

I claim:

1. Apparatus for improving the operation of oil-fired boilers comprising an oil burner and a combustion chamber the wall zone of which is provided with water-conducting cavities, characterized by one or more incombustible blocks (10) which are provided with longitudinal and transverse bores or recesses and are disposed in the combustion chamber (1) at a specific distance in front of the wall (2) situated opposite to the oil burner (4), characterized in that the longitudinal bores or recesses (11) being orientated in the direction of the flame (5) of the oil burner (4) and have a diameter which is larger than that of the transverse bores or recesses (13).

2. Apparatus according to claim 1, characterized in that the inlet location of the longitudinal bore or recess (11) is provided with a transition zone (12).

3. Apparatus according to claim 1, characterized by the provision of two rows of transverse bores or recesses (13).

4. Apparatus according to claim 1, characterized in that each block (10) has an external dimension of approximately 15 cm on 8 cm × 8 cm.

5. Apparatus according to claim 1, characterized in that the longitudinal bore or recess (11) has a diameter of approximately 3.5 cm and the transverse bores have a diameter of approximately 1.5 cm.

6. Apparatus according to claim 1, characterized in that the blocks (10) are constructed of cast iron.

7. Apparatus for improving the operation of oil-fired boilers comprising an oil burner and a combination chamber the wall zone of which is provided with water-conducting cavities, characterized by one or more incombustible metal blocks (10) which are provided with longitudinal and transverse bores or recesses and are disposed in the combustion chamber (1) at a specific distance in front of the wall (2) situated opposite to the oil burner (4) and spaced from the oil burner a distance such that the flame from the oil burner occasionally reaches the metal blocks, the longitudinal bores or recesses (11) being oriented in the direction of the flame (5) of the oil burner (4).

8. Apparatus for improving the operation of oil-fired boilers comprising an oil burner and a combustion chamber the wall zone of which is provided with water-conducting cavities, characterized by one or more incombustible metal blocks (10) which are provided with longitudinal and transverse bores or recesses and are disposed in the combustion chamber (1) at a specific distance in front of the wall (2) situated opposite to the oil burner (4) and spaced from the oil burner a distance such that the flame from the oil burner occasionally reaches the metal blocks, the inlet location of the longitudinal bore or recess (11) being provided with a transiton zone (12).

* * * * *